United States Patent [19]

Straub

[11] 4,369,969

[45] Jan. 25, 1983

[54] BODY EXERCISING DEVICE

[75] Inventor: Willy Straub, Nellingen, Fed. Rep. of Germany

[73] Assignee: Georg Kirchner, Markgroeningen, Fed. Rep. of Germany

[21] Appl. No.: 243,343

[22] Filed: Mar. 13, 1981

[30] Foreign Application Priority Data

Mar. 22, 1980 [DE] Fed. Rep. of Germany ..... 3011208

[51] Int. Cl.[3] ..... A63B 21/00

[52] U.S. Cl. ..... 272/144; 272/51

[58] Field of Search ..... 272/134, 146, 144, 37, 272/1 R, 51, 50, 46

[56] References Cited

U.S. PATENT DOCUMENTS 2,550,992 5/1951 Goodrich ..... 272/144
2,707,465 5/1955 Nemeth ..... 272/146
2,854,064 9/1958 Judd ..... 272/51
2,862,710 12/1958 Lewis ..... 272/134 X

FOREIGN PATENT DOCUMENTS 1929340 3/1970 Fed. Rep. of Germany ..... 272/144
5217926 2/1957 Japan ..... 272/146

*Primary Examiner*—Richard J. Johnson
*Attorney, Agent, or Firm*—Michael J. Striker

[57] ABSTRACT

A body exercising device has a support, a bracket element arranged on the support rotatable about a first axis, and a user supporting element arranged on the bracket element eccentrically rotatable about a second axis, wherein the user supporting element is plate-shaped and formed as a seat for a user, and the bracket element and the user supporting element are arranged so that their axes extend in a substantially vertical direction.

22 Claims, 4 Drawing Figures

BODY EXERCISING DEVICE

BACKGROUND OF THE INVENTION

The present invention relates to a body exercising device. More particularly, it relates to an exercising device which has a support, a pivotally mounted bracket element, and an eccentrically pivotable user supporting element.

Exercising devices of the above-mentioned general type are known in the art. One of such exercising devices is disclosed, for example, in the German Pat. No. 2,420,826. The device disclosed in that patent has two disk-shaped bracket elements located near one another and each provided with an eccentrically mounted user supporting element. When each hand is supported on a respective one of the supporting elements, the arms can perform swinging movements, and when each foot is supported on a respective one of the supporting elements, the legs can perform the swinging movement, for exercising and making stronger the user's body. The known device, however, has the disadvantage in the fact that it cannot be utilized for some special exercises.

SUMMARY OF THE INVENTION

Accordingly, it is an object of the present invention to provide a device for body movement exercises which avoids the disadvantages of the prior art.

More particularly, it is an object of the present invention to provide an exercising device which is particularly suitable for therapy of persons with hip, pelvis and vertebral injuries.

It is also another object of the present invention to provide an exercising device which can be utilized for therapeutic gymnastics of paraplegic or partially paralyzed persons.

In keeping with these objects, and with others which will become apparent hereinafter, one feature of the present invention resides, briefly stated, in a body exercising device which has a support, a bracket element pivotally mounted on the support, and a user supporting element eccentrically pivotally mounted on the bracket element, wherein the user supporting element is formed as a plate-shaped seat for a user, and pivot axes of the bracket element and the supporting element extend in a substantially vertical direction.

In accordance with another advantageous feature of the present invention, the distance between the pivot axes of the bracket element and supporting element can be adjusted so that the device can be utilized in especially universal manner and adjusted to the movement possibilities of individual patients. In this case the device can also be advantageously utilized for movement therapy of joint rheumatism-arthritis. A person who is to exercise sits on the seat face of the user supporting element and the latter performs circular movements while being guided in the bracket element.

In accordance with still another advantageous feature of the present invention, the pivot axes of the bracket element and supporting element extend parallel to one another and can be adjusted so as to change their angle relative to a setting surface of the support. Thereby the device can be considerably adjusted in correspondence with the flexibility of the verterbrae.

In accordance with a further feature of the present invention, the axis of at least one of the bracket element and supporting element can be adjusted so that in one position it extends parallel to the axis of the other element and in another position it is inclined to the latter.

Still a further feature of the present invention resides in that the seat face of the supporting member can be adjusted in a vertical direction relative to the setting surface of the support. Thereby, the device can be adjusted to the dimension of the user's body.

Yet another feature of the present invention is that at least one handle may be provided on the support for the user's safety. It is advantageous when two such handles are arranged at two opposite sides of the support in the region of the supporting element. The handle may be bracket-shaped and overlap the seat surface similar to the handles utilized on some amusement park vehicles. Such a handle can be easily grasped by a user and then either by the arm alone or with the aid of the foot, circular body movements can be performed and repeated in a dozed manner.

Further, the position of the handle or handles relative to the support can be adjusted, particularly for patients with strong body restraint. In this case, such patients can utilize the device safely.

The weight of the device may be kept as small as possible when the support is formed as a tubular frame provided with three, advantageously four, legs arranged on its setting surface, and a bearing element is mounted on the frame for supporting the rotatable bracket element. For space-economical storage and for transportation, the tubular frame may be foldable or disassemblable.

The bearing element may be formed, for weight-saving purposes, of two plates which are mounted on tubular members of the tubular frame and are parallel to the setting surface of the frame in spaced relationship with the latter.

For providing stable construction of the tubular frame, the latter may include a substantially trapezoidal base frame part having downwardly extending legs, a tubular member extending upwardly from the wider end of the base frame part and bent horizontally to support the plates of the bearing element, and a bracing member supporting the tubular member and extending toward the narrower end of the base frame part.

For safe operation of the device, the support can be provided with a foot-supporting member, which is formed for example as a U-shaped bracket extending at an angle to the base frame part.

An additional feature of the present invention is that for adjusting the distance between the axes of the bracket element and the supporting element, the bracket element may be formed as a U-shaped guide with an upwardly open recess, a bearing part of the supporting element is pivotally mounted in the recess, and the bearing part is displaceable relative to the U-shaped guide.

It is advantageous when the U-shaped guide is provided with an opening through which at least one mounting screw extends for adjustable mounting of the bearing part.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF A PREFERRED EMBODIMENT

Figure 1:
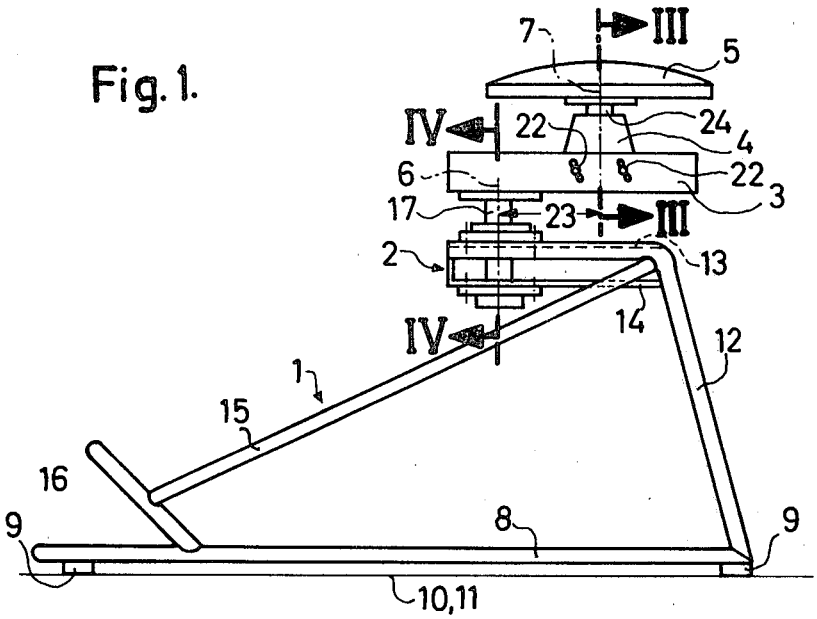
FIG. 1 is a side view of a body exercising device in accordance with the present invention.
Figure 2:
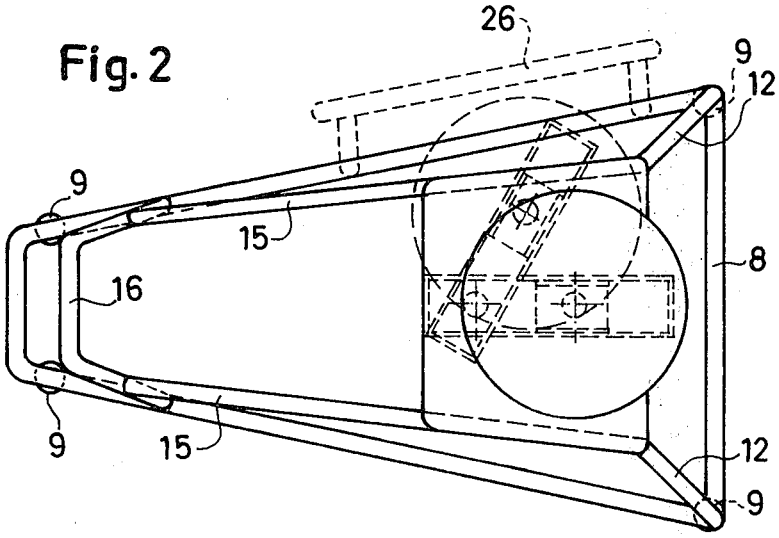
FIG. 2 is a plan view of the body exercising device shown in FIG. 1 with an optional handle shown in dotted lines.

A body exercising device has a support which is identified by reference numeral 1, a bearing element identified by reference numeral 2 and arranged at the height of knees, and a bracket element 3 supported by the bearing element 2. A user supporting element 5 has a bearing part 4 pivotally supported on the bracket element 3. As can be seen from the drawings, a pivot axis 6 of the bracket element 3 and a pivot axis 7 of the supporting element 5 extend parallel to one another in a vertical direction.

A support 1 is composed of tubular members and has a substantially trapezoidal base part 8 provided with legs downwardly extending from the base part 8 in the regions of its corners. The legs 9 together form a setting surface 10 for the exercising device, with which the device is placed onto a floor 11. Two tubular members 12 extend upwardly from the wider side of the base part 8 and are bent horizontally at their upper end. The bearing element 2 includes two parallel plates 13 and 14 which are spaced from one another, of which the plate 13 is supported on the bent horizontal portions of the tubular members 12. The plates 13 and 14 of the bearing element 2 are parallel to the setting surface 10 of the support 1.

The tubular members 12 are supported by inclined tubular members 15 which in turn are connected with and supported on a U-shaped foot-supporting member 16. Thereby they are also supported on the base part 8 of the support 1. The thus designed support 1 is very stable and at the same time has a very small weight.

Figure 3:
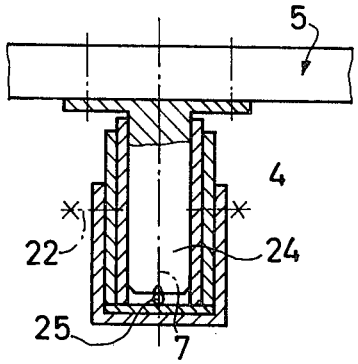
FIG. 3 is a view showing a section taken along the line III—III in FIG. 1.
Figure 4:
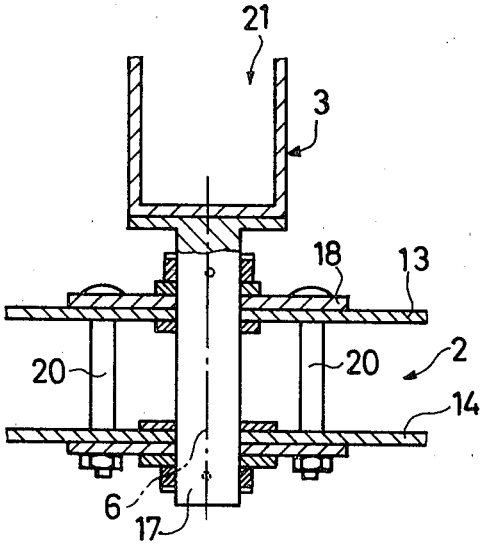
FIG. 4 is a view showing a section taken along the line IV—IV in FIG. 1.

As can be seen from FIG. 4, the bracket element 3 is U-shaped and has a downwardly extending cylindrical guiding part 17. The guiding part 17 extends through the plates 13 and 14 of the bearing element 2 and is pivotable about the pivot axis 6. The plates 13 and 14 are reinforced in the bearing region by plates 18 and 19 and connected with one another by screws 20. The U-shaped bracket element 3 is open upwardly and forms a receiving recess 21 in which a bearing part 4 for pivotally supporting the supporting element 5 is received. The supporting element 5 is plate-shaped and formed as a seat. More particularly, it has an upper plate-shaped surface. As can be seen from FIGS. 1 and 3, the bearing part 4 is held in the bracket element 3 adjustably with the aid of schematically shown screws 22. Thereby, the distance 23 between the pivot axes 6 and 7 can be adjusted. The supporting element 5 has a cylindrical pin 24 which is pivotally guided in the bearing part 4. The end face of the pin 24 abuts against a ball 25 for reducing the friction.

For safely exercising of a user, the support 1 may be provided at its one side or at its both sides with a handle 26. The handle 26 can be mounted on the support 1 detachably and adjustably. The device may also be equipped with the handles later on.

When the bearing part 4 tilts in the recess 21, the pivot axis 7 of the supporting element 5 can be inclined relative to the pivot axis 6 of the bracket element 3, if it is desirable to provide a further therapeutic effect.

It will be understood that each of the elements described above, or two or more together, may also find a useful application in other types of constructions differing from the types described above.

While the invention has been illustrated and described as embodied in a body exercising device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for varous applications without omitting features that, from the standpoint of prior art, fairly constitute essential characteristics of the generic or specific aspects of this invention.

What is claimed as new and desired to be protected by Letters Patent is set forth in the appended claims:

1. A body exercising device, comprising a support; a bracket element arranged on said support rotatable about a first axis; and a user supporting element arranged on said bracket element eccentrically rotatable about a second axis, said user supporting element being plate-shaped and formed as a seat for a user, and said bracket element and user supporting element being arranged so that said first and second axes extend in a substantially vertical direction and are spaced from one another by a predetermined ajustable distance, and said user supporting element being movable relative to said bracket element between a first position in which said second axis of said user supporting element is parallel to said first axis of said bracket element and a second position in which said second axis of said user supporting element is spaced from and inclined relative to said first axis of said bracket element; means for adjusting the distance between said axes of said bracket element and said user supporting element; and means for adjusting an angle between the axis of said user supporting element and the axis of said bracket element.

2. A body exercising device as defined in claim 1, wherein said means for adjusting the distance between said user supporting element and said bracket element and said means for adjusting the angle between the axes of said user supporting element and said bracket element are formed as a single means performing both said distance adjustment and said angle adjustment.

3. A body exercising device as defined in claim 1, wherein said support has a setting surface with which it is placed onto a base, said bracket element and said supporting element being arranged so that said axes of said elements are inclinable toward said setting surface of said support; and further comprising means for adjusting an angle between said axes of said elements and said setting surface of said support.

4. A body exercising device as defined in claim 1, wherein said support has a setting surface with which it is placed onto a base, said seat having a plate-shaped seat face and being vertically displaceable relative to said support so as to adjust a distance between seat face and said setting surface of said support; and further comprising means for vertically adjusting the distance between said seat face and said setting surface of said support.

5. A body exercising device as defined in claim 1; and further comprising at least one handle provided on said support.

6. A body exercising device as defined in claim 5; and further comprising a second such handle provided on said support, said handles being arranged at opposite sides of said support in the region of said seat.

7. A body exercising device as defined in claim 5, wherein said handle is mounted on said support displaceable relative to the latter so that the location of said handle relative to said support can be adjusted; and further comprising means for displaceably and adjustably mounting said handle on said support.

8. A body exercising device as defined in claim 5, wherein said handle is detachably mounted on said frame; and further comprising means for detachably mounting said handle on said frame.

9. A body exercising device as defined in claim 1, wherein said support is formed as a tubular frame and provided with at least two legs defining a setting surface with which said support is placed onto a base.

10. A body exercising device as defined in claim 9, wherein said tubular frame is provided with four such legs.

11. A body exercising device as defined in claim 1; and further comprising a bearing element mounted on said support and arranged to support said bracket element and user supporting element.

12. A body exercising device as defined in claim 11, wherein said support has a setting surface with which it is placed onto a base, said bearing element including two plates which are parallel to and spaced from one another and also parallel to and spaced from said setting surface of said support.

13. A body exercising device as defined in claim 12, wherein said bracket element has a cylindrical guide part extending through said two plates of said bearing element and having an axis which forms said first axis of said bracket element.

14. A body exercising device as defined in claim 13; and further comprising a ball member arranged in said bearing element and pivotally supporting said cylindrical pin of said supporting element.

15. A body exercising machine as defined in claim 11, wherein said support is formed as a tubular frame which has a trapezoidal base part with wider and narrower ends and with legs, said frame further having a tubular member which extends upwardly from said wider end of said base part and is bent horizontally to support said bearing element, said frame also having a bracing member which supports said tubular member and extends toward said narrower end of said base part.

16. A body exercising machine as defined in claim 15, wherein said frame has a foot supporting member.

17. A body exercising machine as defined in claim 16, wherein said foot supporting member extends at an angle to said base part and is formed as a U-shaped bracket.

18. A body exercising machine as defined in claim 17, wherein said bracing member has two ends and is connected at one of its ends with said tubular member and at the other of its ends with said foot supporting member of said support.

19. A body exercising device as defined in claim 1, wherein said bracket is formed as an upwardly open U-shaped guide, said supporting element being provided with a bearing part which pivotally supports said supporting member and is displaceably mounted inside said U-shaped guide.

20. A body exercising device as defined in claim 19, wherein said supporting element is pivotable between a plurality of angular positions and said bearing part is displaceable between a plurality of longitudinal positions; and further comprising means for fixing said supporting member and said bearing part inside said U-shaped guide in each of said positions.

21. A body exercising device as defined in claim 20, wherein said U-shaped guide has a throughgoing opening, said fixing means including at least one mounting screw extending through said opening.

22. A body exercising device as defined in claim 20, wherein said supporting element is provided with a cylindrical pin which is rotatably guided in said bearing element and forms said second axis of said supporting element.

* * * * *